United States Patent [19]

Margen et al.

[11] 4,108,240

[45] Aug. 22, 1978

[54] HEAT EXCHANGER SYSTEM

[75] Inventors: Peter Heinrich Erwin Margen; Rolf Paul Näslund, both of Nyköping, Sweden

[73] Assignee: Aktiebolaget Atomenergi, Stockholm, Sweden

[21] Appl. No.: 681,471

[22] Filed: Apr. 29, 1976

[30] Foreign Application Priority Data

May 7, 1975 [SE] Sweden ..... 7505362

[51] Int. Cl.[2] ..... F28D 7/00; F28F 9/22

[52] U.S. Cl. ..... 165/125; 165/162; 165/172; 165/178

[58] Field of Search ..... 165/125, 162, 172, 178

[56] References Cited

U.S. PATENT DOCUMENTS

| | | | |
|---|---|---|---|
| 1,634,812 | 7/1927 | Whitehead | 165/129 |
| 1,901,090 | 3/1933 | Eule et al. | 165/172 X |
| 2,044,832 | 6/1936 | Child | 165/125 X |
| 2,433,546 | 12/1947 | Cornelius | 165/180 X |
| 2,559,272 | 7/1951 | Beck | 165/183 X |
| 2,657,020 | 10/1953 | Hofmeister | 165/172 |
| 3,100,523 | 8/1963 | Marrujo | 165/162 |
| 3,277,959 | 10/1966 | Withers | 165/180 X |
| 3,295,598 | 1/1967 | Metzger | 165/172 |
| 3,616,849 | 11/1971 | Dijt | 165/125 X |
| 3,639,963 | 2/1972 | Maher | 165/162 |
| 3,978,919 | 9/1976 | Fachbach et al. | 165/125 X |
| 4,030,540 | 6/1977 | Roma | 165/172 |

FOREIGN PATENT DOCUMENTS

| | | | |
|---|---|---|---|
| 622,057 | 5/1927 | France | 165/125 |
| 170,712 | 7/1935 | Switzerland | 165/172 |
| 1,046,570 | 10/1966 | United Kingdom | 165/162 |

*Primary Examiner*—Charles J. Myhre
*Assistant Examiner*—Sheldon Richter
*Attorney, Agent, or Firm*—Burns, Doane, Swecker & Mathis

[57] ABSTRACT

There is provided a heat-exchanger system for heat-exchange between a gas such as air and a liquid such as water, comprising at least one heat exchanger unit which unit comprises at least one tube which is wound to form a hollow coil and which is arranged to conduct said liquid, characterized thereby, that said coil is closed or covered at one end; in that the other end of said coil which is open, is placed against a base plate having an opening which is aligned with the coil opening and has a size and shape corresponding to those of the coil opening; and in that the turns of the coil are slightly separated in order to permit the gas to flow perpendicularly across the tube during the passage through the wall of the coil.

9 Claims, 17 Drawing Figures

1
2
3
4
5
6
7
9
10
20
21
22

HEAT EXCHANGER SYSTEM

The present invention relates to a heat-exchanger system comprising at least one and preferably several heat-exchanger units each unit consisting of one or more tubes, preferably made of plastic, wound to form a hollow coil.

At the present time there is an urgent requirement for heat-exchangers for the institution of heat transfer between water on the one hand and air on the other. Heat-exchangers of this kind are used for example to recover heat from the air discharged from dwelling houses and factories. Other applications of this kind of heat-exchanger are to heat air in rooms or to remove excess heat from rooms.

A primary object of the invention is, therefore, to provide a simple and efficient heat-exchanger system of the convector type.

The system in accordance with the present invention is useful for heat exchange between air and water and comprises at least one heat-exchanger unit, which unit comprises at least one, but preferably several tubes which are wound to form a hollow coil and which are arranged to conduct water.

The coil is closed or covered at one end. The other end of the coil, which is open, is placed against a base plate having an opening. This opening is aligned with the coil core and has a size and a shape corresponding to the coil core opening. Moreover the tube turns of the coil are slightly separated in order to permit the air to flow perpendicularly across the tube during the passage through the wall of the coil.

The coil preferably comprises a plurality of tubes, say 20–100 tubes which are wound in parallel.

Moreover the system of the present invention may comprise a plurality of coils. The coil may have conical shape, whereby a plurality of coils can be placed in contact with each other (at the base surfaces), thus permitting a very compact construction while maintaining the air flow substantially radially to the axis of each coil.

In a preferred embodiment of the invention, the tubes consist of a heat resistant plastic such as cross-linked polyethylene.

Preferably, each coil has a conical or cylindrical central cavity. Fillets are inserted at regular angular intervals. For an interval of 90° the fillets may have a radial thickness of ($\sqrt{2} - 1$) times the tube diameter. For this reason, the tube may be made by a simple winding procedure while still obtaining a substantially square cross section, whereby the coils can be closely packed on the base plate. These fillets are preferably provided with notches in order to guide the tubes and keep them in predetermined mutual distances.

The array of tubes that is wound to form a coil, may be wound in zig-zag, the bends being positioned at predetermined angular intervals. There should be an odd number of bends so that it will not be necessary to insert spacers between the tube coils, as the tube bends will constitute a notched configuration in which the next layer of tubes is guided.

In order that the invention should be better understood, it will be described in detail below, reference being made to the accompanying drawings.

Figures 9, 9A:
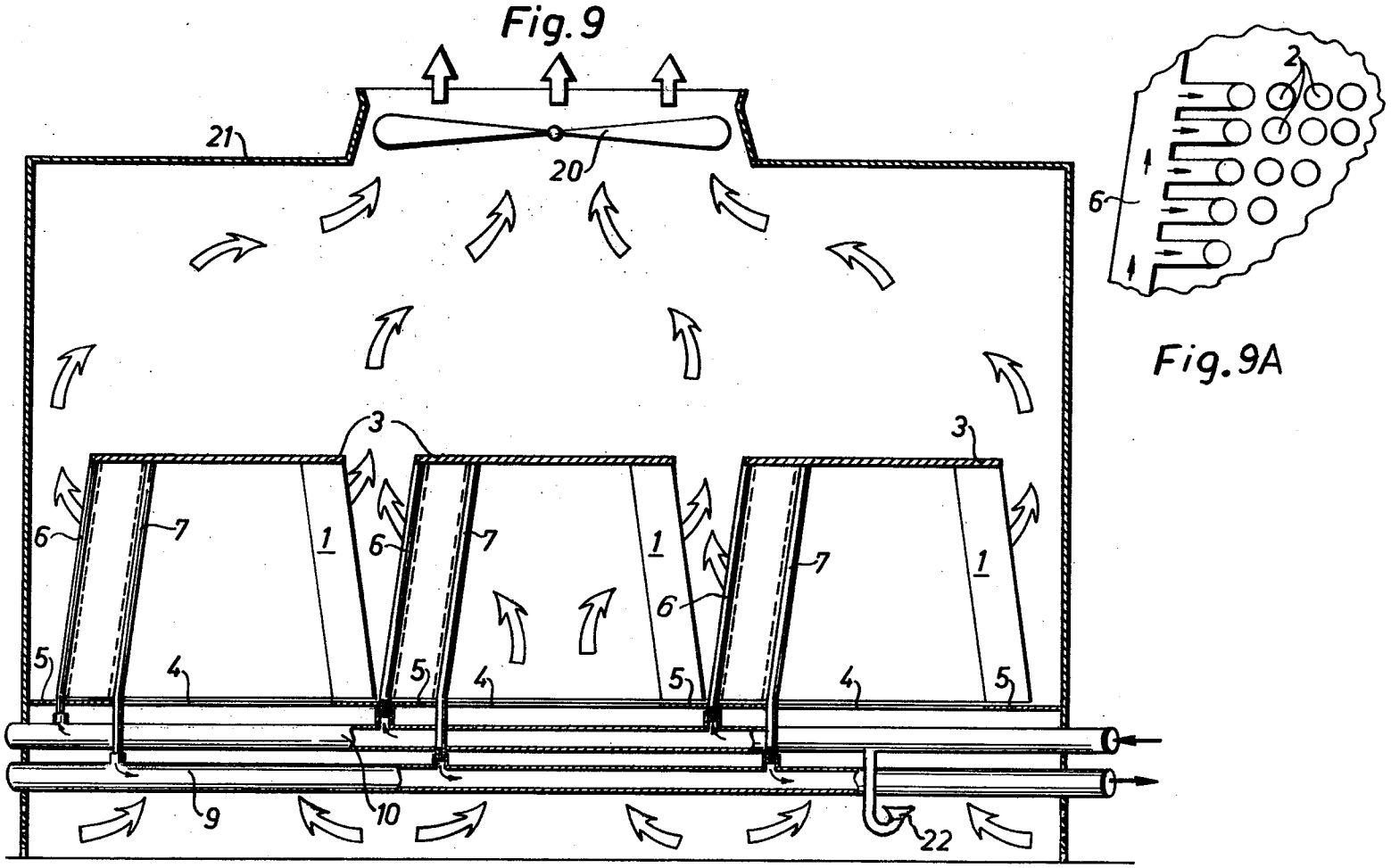
FIG. 9 illustrates an arrangement which comprises a plurality of coils.

FIG. **9*a* shows a detail of the coil in FIG. 9**.

Figure 10:
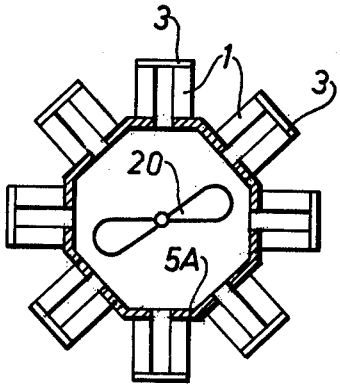

FIG. 10 illustrates an alternative arrangement comprising a plurality of coils in accordance with the invention.

Figure 12:
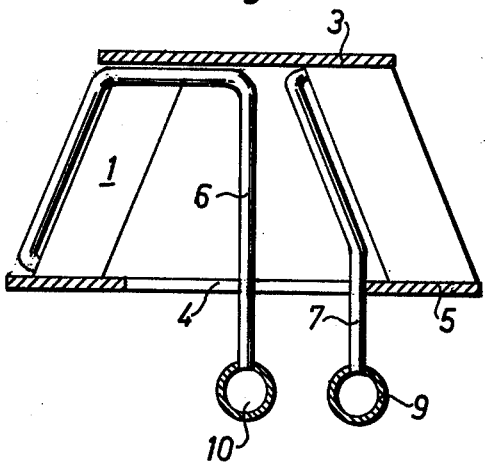

FIG. 12 schematically illustrates how the manifold tubes for the coil, at inlet and outlet ends, can be disposed centrally in the coil.

Figure 1:
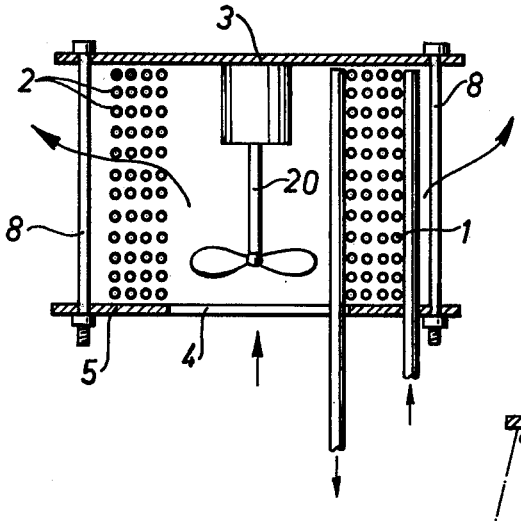
FIGS. 1 and 2 are a schematic showing, in axial section, of the heat-exchanger coils in accordance with the invention.

FIG. 1 illustrates a hollow coil 1 of plastic tubing 2. The top end of the coil is closed off by a disc 3 and the central opening in the coil is disposed centrally above an opening 4 in a baseplate 5. A distributor pipe 6 is connected to the external ends of the tubes 2 and a manifold pipe 7 is connected to the internal ends of the tubes 2. Axial bolts 8 extend between the plate 5 and the disc 3 and hold the coil 1 together in this way.

Figure 2:
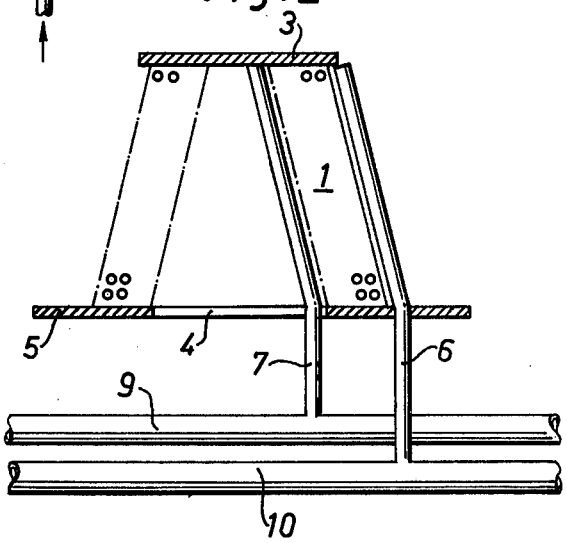
Figure 3:
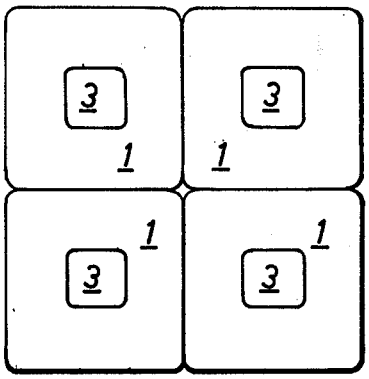
FIGS. 3 and 4 illustrate a plan view of the coils of FIGS. 1 and 2, respectively.
Figure 4:
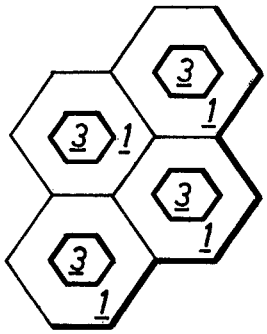
Figure 5:
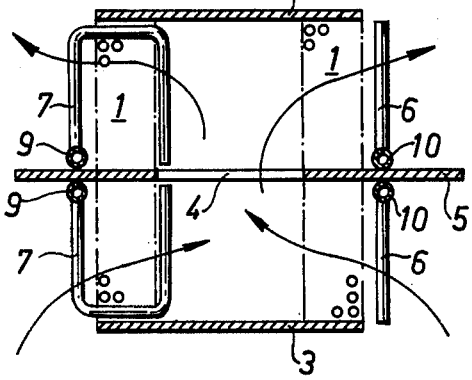
FIG. 5 illustrates an arrangement of the coils in accordance with the invention.
Figure 5A:
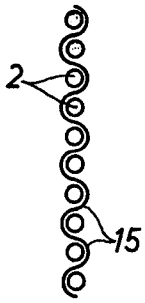
FIGS. 5A–5C illustrate tube spreaders or fillets for use in the coils.
Figure 5B:
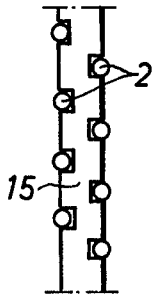
Figure 5C:
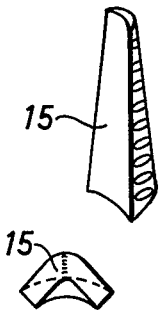

FIG. 2 illustrates a heat-exchanger unit corresponding to that shown in FIG. 1, in which, however, the coil 1 has a conical cross-section. In addition, the illustrations show how the distributor pipe 6 and the manifold pipe 7 are plugged into main lines 10 and 9, respectively. The plug-in connection can be of the sliding seal type, thus facilitating exchange of a unit 1 should it develop a malfunction. In the plan views of FIGS. 3 and 4, it is shown how the area of the plate 5 can best be utilized by giving the conical or pyramidal coils a polygonal base surface configuration. In FIG. 5 it can be seen how the units 1 can be arranged centrally opposite one another with an opening 4 in the plate 5. In this embodiment, however, manifold pipe 7 is taken through the coil for connection outside the latter to main line 9. In a corresponding way the distributor pipe 6 is connected to main line 10 which is arranged at the same side of the disc 5 as the corresponding coil 1. In FIGS. 5A and 5B tube spreaders **15*a* and 15*b*, respectively are shown which are designed to be arranged between the turns of the sets of tubes 2 in order to maintain the tubes at the desired mutual interval. In FIG. 5C a pyramid-shaped spacer or fillet 15*c* has been shown which, when the coil is wound on a cylindrical cone, is arranged at intervals of 90° in order to give the wound cone a pyramidal shape with a square base area, thus producing the configuration shown in FIG. 3. The fillet 15*c*** has a thickness in the radial direction of the coil, of around ($\sqrt{2} - 1$) times the diameter of the plastic tube. With a coil in accordance with the invention, the water flows spiral fashion from the centre to the periphery of the coil through several turns of the tube located one outside the other.

At the same time, the air flows radially inward. Alternatively, the two flow directions are reversed. As far as the temperature gradient is concerned, a "counterflow" arrangement is obtained, i.e. the coldest water meets the coldest air and the hottest water the hottest air, in the situation where the air is to be cooled. At the same time, a "cross-flow" is obtained, i.e. the air flows in a direction at right angles to the tube through which the water is passing, so that high heat transfer coefficients are obtained. This yields maximum efficiency.

These technical principles are of course well-known but in the context of the present invention they have proven their efficiency.

Figure 6:
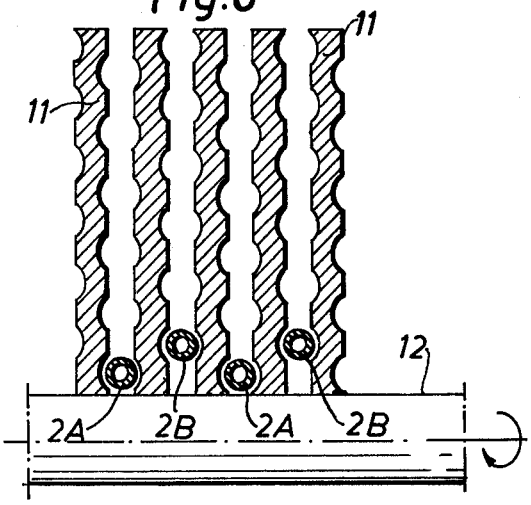
FIG. 6 illustrates a special type of tube spreader which can be used when winding a coil in accordance with the invention.
Figure 7:
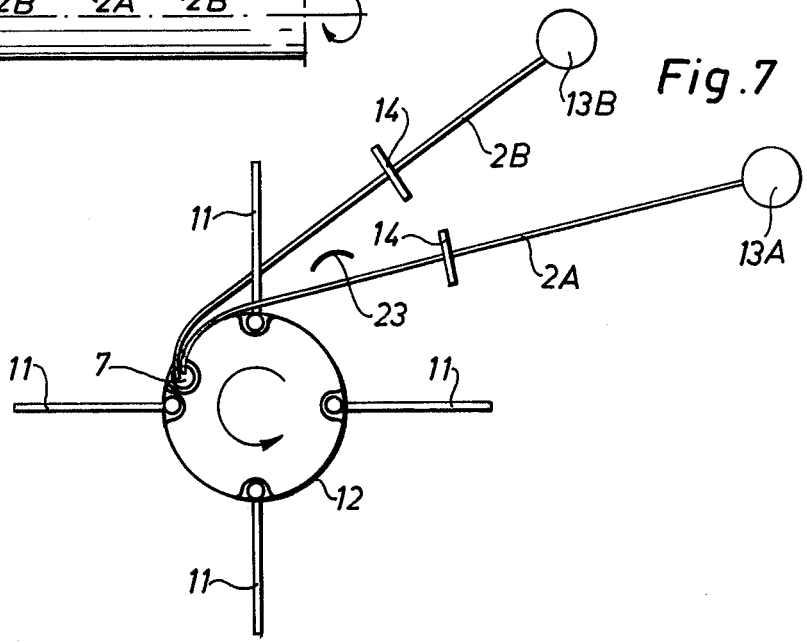
FIG. 7 is a side elevation showing how a coil can be wound using spreaders in accordance with FIG. 6.

In FIGS. 6 and 7, spacers 11 can be seen which are used in the manufacture of a coil in accordance with the invention. If a pair of adjacent spacers 11 are considered in closer detail, it can be seen that, at sides facing one another, the spacers are provided with centrally opposed recesses which in combination with the gap between spacers are designed to accommodate tubes 2A and 2B. In adjacent gaps designed to take tubes, the recesses are radially staggered by a distance corresponding to half the pitch of the tube coil. When the tube 2A is introduced into its respective recesses, in the manner shown in FIG. 6, the spacers 11 located inside the windings of tube 2A are guided up by the tube 2A so that tube 2B cannot be moved further down than the position shown in FIG. 6. The tube 2B in turn stiffens the spacers so that the next turn of the tube 2A cannot be moved further down than the intended recesses. FIG. 7 illustrates how the spacers 11 are detachably fixed in a rotatable winding drum 12. Two tube sets 2A and 2B have their ends fixed in a manifold pipe 7 which is arranged in a recess in the external surface of the drum. The tube sets 2A and 2B extend at an angle to one another so that the set 2A penetrates deepest between the spacers 11 and therefore stiffens the latter up with the result that the tube set 2B cannot penetrate down any further than the intended recesses as shown in FIG. 6. The tube sets 2A and 2B pass through comb structures 14, the tubes running through the gaps thereof with a certain degree of friction so that they are held tensioned in the desired alignment during winding.

In order that the tube turns should maintain a spiral shape during winding according to the procedure shown in FIG. 7, and not, be deformed into a polygonal shape because of stretching of the tube, disc-shaped tube spreaders 15 are employed, for example at angular intervals of 45° from the spacers 11. When the coil has been completely wound the discs are removed.

Figure 8:
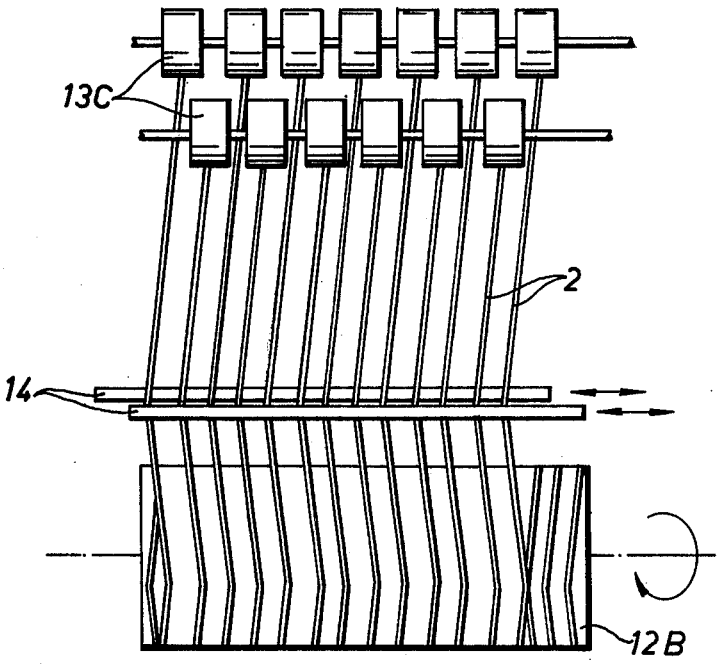
FIG. 8 illustrates an arrangement for winding a coil in accordance with the invention and FIG. 8A illustrates a comb element which is used in the arrangement of FIG. 8.

FIG. 8 illustrates how a straight, polygonal coil in accordance with the invention can be manufactured. The coil is wound on a removable core drum 12B having, for example, a triangular cross section. The ends of the tube 2 are directed to a manifold pipe (this has not been shown but can be accommodated in the drum 12B in a manner similar to that shown in FIG. 7). The tube 2 is unwound from the drums **13*c* and is guided during the winding operation by one or more comb arrangements 14. During winding, the combs 14 are oscillated axially as shown in FIG. 8, so that the direction of winding of the tube changes after passing each edge of the core 12B. The underlying layer of tube 2 on the coil consequently, exhibits a recessed space between each individual winding in which, at the corners of the drum 12*B*, the individual windings in the topmost layer are laid down thus enabling the pitch of the tube to be maintained and the tube secured in position with changes in direction. The spacing effect described can of course be obtained by additionally introducing corrugated or plastic strips, for example as shown in FIGS. 5A and 5B, at the corners of the coil on the drum 12*B*. FIG. 8 shows how the comb structures 14 illustrated schematically in FIGS. 7 and 8 appear. The gaps between the comb teeth can be narrower than the diameter of tube 2** so that the latter, in passing through the gap experiences a deformation resistance or friction.

A drum with a polygonal circumference will have an odd number of corners, three or five. The zig-zag wound tube can, therefore reverse its direction only above the particular tube turn located closest below it.

Figure 8A:
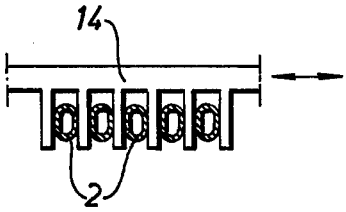

The comb structures 14 shown in FIG. 8A can be displaced simultaneously in the same axial direction or they can be displaced synchronously but in opposite directions.

FIG. 9 illustrates how coils in accordance with the invention can be assembled to form a heat-exchanger system. The coils 1 are supported by a plate 5 and are placed with their base surfaces in contact with one another in order to make best use of the available area on the plate 5. The coils are covered at the top by a disc 3. If required, the coils 1 can be matched conically so that the part removed from the plate 5 to provide access for airflow, corresponds to the requisite dimensions of the disc 3. The coils 1 each possess a distribution pipe 6 and a manifold pipe 7 which are connected to principal lines 10 and 9, respectively by means of sliding couplings. The coils 1 are assembled in a casing or housing 21 and a fan 20 or the like can be provided in order to produce air flow through the heat-exchanger units 1.

Figure 11:
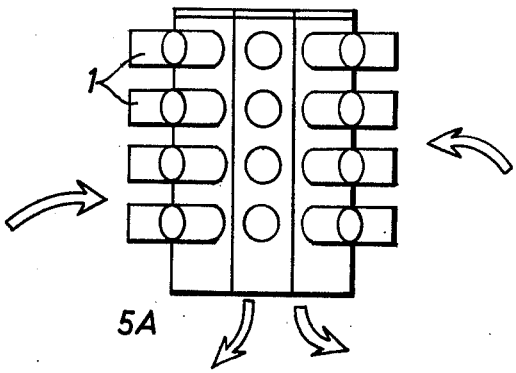

FIGS. 10 and 11 illustrate a variant embodiment of the heat-exchange system shown in FIG. 9, in which the baseplate 5A consists of a polygonal (octagonal) cylindrical shell which is closed at one end. A fan 20 can be provided inside baseplate 5A. The facets of the baseplate are provided with openings over which the tube coils 1 are placed. In this manner, a large number of standard and easily exchangeable coils can be arranged on a common baseplate so that all the coils 1 are easily accessible.

FIG. 12 illustrates an alternative construction of the coil 1 for use in a heat-exchanger system of the kind shown in FIG. 9. In the embodiment shown in FIG. 12 the distributor pipe 6 is introduced into the central opening of the coil so that the main lines 9 and 10 can be laid adjacent one another in order to facilitate assembly and the insertion of the lines 6 and 7 into lines 9 and 10.

It will be evident that the coil shown in FIG. 1 can be used, for example, as a separate air-cooler, in which case the plate 5 consists of a ring substantially of the same width as the coil 1, the disc 3 consists of a fixed part of a structure such as a roof or a wall in the room where the air is to be heated or cooled.

In manufacturing coils in accordance with the invention it has been found highly advantageous if a large number of tubes, say 30 to 100, preferably at least 30 to 40, are fixed in a plenum chamber 7 (which may take the form of the manifold pipe shown) and the plenum chamber attached to the core around which the coil is to be wound. The coil is then rotated the desired number of turns during winding of one or more flat tube sets, for example 10 to 30 turns, after which the tube set is cased and fixed in a plenum chamber 6 (distributor pipe).

Referring to FIG. 9, it will be clear that the fan 20 can be replaced by a flue which is sufficiently high to produce a natural draft through the heat-exchanger system.

If the tube coils 1 carry hot water whose heat content is to be transferred to the air, then water can be tapped off, for example from the line 10 to the spray nozzles 22 so that a liquid spray is introduced into the airflow to wet the surface of the coils 1. This results in a considerable increase in heat transfer coefficient.

The heat-exchanger described can be matched to differing temperature requirements by choosing the least expensive type of plastic which is acceptable for the particular temperature, such as, for example polyethylene for relatively low temperatures, polybutylene for higher temperatures and cross-linked polyethylene for even higher temperatures. Furthermore, the tube can be of a kind provided with circumferential corrugations.

What is claimed is:

1. A heat-exchanger system for heat-exchange between a gas and a liquid comprising:

(a) a base plate;

(b) a plurality of plastic tube coil units tightly packed and mounted on said base plate, each of said coil units comprising a length of plastic tubing wound to form said coil, the windings of said coil units being slightly spaced, said coil units having open ends and a hollow interior and wound to present a frusto-conical profile, said frusto-conical coil unit having a larger base and a smaller base, said base plate having an opening therein aligned with and corresponding to the size and shape of the open end of said larger base of said coil unit adjacent thereto;

(c) closure means covering the open end of said smaller base of said coil unit opposite to that on the base plate;

(d) means in said closure means for causing gas to flow through the interior of said coil unit windings in a direction generally perpendicular to the conical surface of said coil unit; and (e) separate delivery and return means connected to the ends of said tubes for delivering and withdrawing liquid, respectively, from said coils.

2. A system as claimed in claim 1, wherein each unit comprises a plurality of tubes and the tubes are wound in concentric and congruent spirals.

3. A system as claimed in claim 1, wherein the turns of coil are separated by spacers.

4. A system as claimed in claim 1, wherein the delivery means and return pipe means for the liquid medium which is to be passed through the tube is arranged centrally in the coil.

5. A system as claimed in claim 1, wherein each tube consists of a heat-resistant cross-linked polyethylene plastic.

6. A system as claimed in claim 1, wherein the base surface of each coil has a polygonal shape.

7. A system as claimed in claim 6, wherein the polygonal shape comprises an odd number of corners and the tube has a mirror-symmetrical direction of winding in relation to adjacent polygonal surfaces.

8. A system as claimed in claim 1, wherein the opening in the base plate is formed by removal of a corresponding section from the plate and the section is placed on the smaller base of the frusto-conical coil to seal the small base of the coil.

9. A system as claimed in claim 8, wherein the smaller base of the coil is equal in and size to the plate section.

* * * * *